United States Patent [19]

Richey

[11] 3,992,005

[45] Nov. 16, 1976

[54] BILLIARD BALL RACK

[76] Inventor: John N. Richey, 22845 Calvert St., Woodland Hills, Calif. 91364

[22] Filed: Oct. 22, 1975

[21] Appl. No.: 624,522

Related U.S. Application Data

[63] Continuation-in-part of Ser. No. 518,613, Oct. 29, 1974, abandoned.

[52] U.S. Cl. ..... 273/22; 16/169; 403/154

[51] Int. Cl.[2] ..... A63D 15/00

[58] Field of Search ..... 273/22; 16/128 R, 169, 16/171; 403/154, 155, 292, 294, 401, 402

[56] References Cited

UNITED STATES PATENTS

| | | | |
|---|---|---|---|
| 952,920 | 3/1910 | Meacham | 273/22 UX |
| 1,089,140 | 3/1914 | Madigan | 273/22 |
| 1,338,260 | 4/1920 | Soss | 16/171 UX |
| 1,660,626 | 2/1928 | Rhoads | 273/22 |
| 1,725,494 | 8/1929 | Varnum | 273/22 |
| 1,857,717 | 5/1932 | Focaracci | 16/171 |
| 3,803,668 | 4/1974 | Remick | 16/128 R |

*Primary Examiner*—Richard T. Stouffer
*Attorney, Agent, or Firm*—Jack C. Munro

[57] ABSTRACT

This invention relates to a new billiard ball rack for holding billiard balls, for playing billiards, pool or any other game utilizing billiard or pool balls in which the rack is formed of three arms interconnected together in a triangular shape by rotating hinges at two of the angles of the triangle and a ball and socket joint at the third angle which is adapted to pop open upon insertion of the last ball. Each hinge is composed of a dowel rotatingly supported within a washer assembly. Located about each hinge is a biasing spring exerting a continuous bias tending to position the rack in the closed position.

3 Claims, 10 Drawing Figures

BILLIARD BALL RACK

REFERENCE TO PRIOR APPLICATION

This application is a Continuation-In-Part of patent application Ser. No. 518,613 filed Oct. 29, 1974, now abandoned, by the present inventor.

BACKGROUND OF THE INVENTION

At the start of each pool game, the balls are placed in the rack which positions the balls into the proper placement for the start of the game and they are then placed in a proper position on the table. In a normal game of pool, fifteen balls are placed in the rack in a pyramid shape. There are other pool games, however, where only nine balls are used and still other pool and billiard games where various amounts of balls are used.

Referring to the more common game of pool where fifteen balls are used, the 15 balls are placed into the rack, placed in the proper position on the table and then the player must carefully lift the rack vertically upward attempting not to touch the balls or jimmy them in any manner whatsoever so that the balls are not moved out of the proper position.

With the standard solid pool rack, even with the utmost of care, the player can often disturb the balls thus making a loose or out of position rack of balls.

SUMMARY OF THE INVENTION

The subject matter of this invention is believed to be summarily described in the Abstract Of The Disclosure and reference is to be had thereto.

It is an object of the present invention to provide a pool ball rack in which the rack can be removed from the balls after the balls are set into position without the possibility of jiggling or moving the balls out of the proper position.

A further object of the invention is to provide a pool ball rack which is not solid but which opens at one of the corners of the triangle allowing the rack to be moved away from the pool balls without nudging them out of position.

DETAILED DESCRIPTION OF THE SHOWN EMBODIMENT

Figure 1:
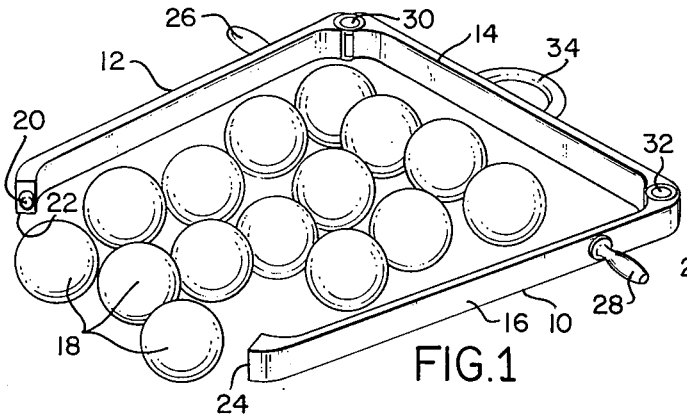
FIG. 1 is a perspective view of the rack of this invention in an open position.

Referring now to FIG. 1, there is shown the rack 10 of this invention consisting of three arms of a triangle 12, 14 and 16. Pool balls 18 are shown in a loose disoriented position within rack 10.

A ball portion 20 of a ball and socket joint is fixedly attached to the upper open end of 22 of arm 12. The socket portion would be at the opposite upper end 24 of arm 16 which is not shown in FIG. 1. Handles 26 and 28 are fixedly attached to the lower ends of arms 12 and 16 and are utilized to pull open and apart arms 12 and 16. Arms 12 and 16 rotate on dowel pin hinges 30 and 32 which connect the lower ends of arms 12 and 16 to the opposite ends of arm 14. By downward pressure on handles 26 and 28, that is pressure in the direction of arm 14, arms 12 and 16 will rotate in opposite directions opening rack 10 to the position shown in FIG. 1. A semicircular handle 34 is fixedly attached to the middle of arm 14 for the purpose of carrying the rack and hanging it on a hook that may be provided by the pool table.

Figure 2:
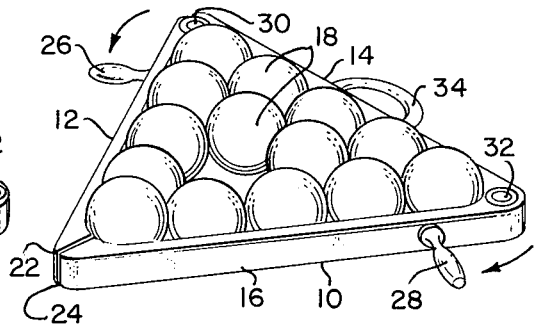
FIG. 2 is a perspective view of the rack of this invention in a closed position with one ball missing from the rack.

Referring now to FIG. 2, there is shown the rack 10 with arms 12 and 14 and 16 with the rack in a closed position. That is ball 20 which is affixed to end 22 of arm 12 is frictionally engaged into the socket in the end 24 of arm 16. It is noted that the pool balls 18 are missing one ball in the rack, that is, in the example shown, there are 14 balls in the rack, and they are slightly out of position. The reason for this is when the 15 ball is inserted into the back it will take a slight pressure to push it down into position which aligns the other balls into their final position and this pressure will cause ball joint 20 to disengage from the socket in the end 24 of arm 16.

Thus, the rack is so designed to be just slightly smaller than the size of 15 balls when they are in a finished position. Therefore, the user does not have to pop open the ball joint 20. If the user had to pop it open he would probably jar the balls out of position, but by simply forcing the final ball into place within the rack, the ball joint is popped open. By using handles 26 and 28, the arms 12 and 16 may be rotated apart and the rack 10 lifted away from the balls without touching them. Arms 12 and 16 rotate in opposite directions on dowel pin hinges 30 and 32. The rack may then be set aside or hung on a hook by handle 34.

Figure 3:
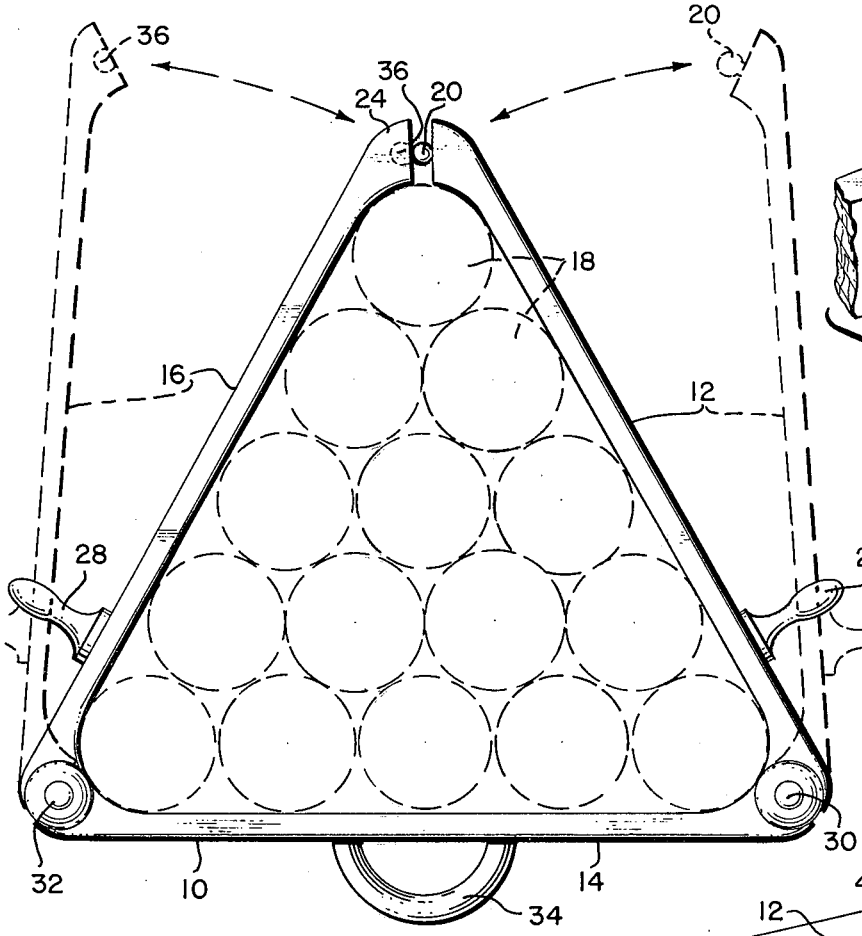
FIG. 3 is a top view of the rack of this invention with a full contingent of pool balls.

Referring now to FIG. 3, there is shown the rack 10 with arms 12 and 14 and 16 in the position in which all fifteen balls are in proper place within the rack. As can be seen, ball 20 has disengaged from socket 36 which is in the end 24 of arm 16. By slight pressure on handles 26 and 28 the arms can be rotated on dowel pin hinges 30 and 32 apart from each other so they assume the position shown in the dotted lines. The rack can then be removed from the pool balls without nudging them out of position and the rack hung on a hook by handle 34.

Handles 26 and 38 are preferably lathe turned in position so as to make a comfortable finger grasp when opening the rack.

Figure 4:
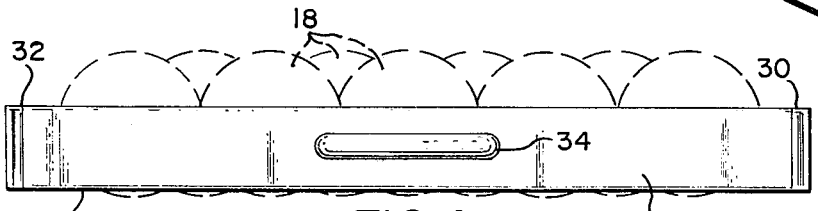
FIG. 4 is a plan view of the rack of this invention as shown in FIG. 3.

FIG. 4 shows rack 10 with arm 14 and balls 18 in position. At opposite ends of arm 14 are dowel pin hinges 30 and 32 upon which arms 12 and 16 can rotate. Handle 34 is fixedly attached to arm 14 at the center thereof.

Figure 5:
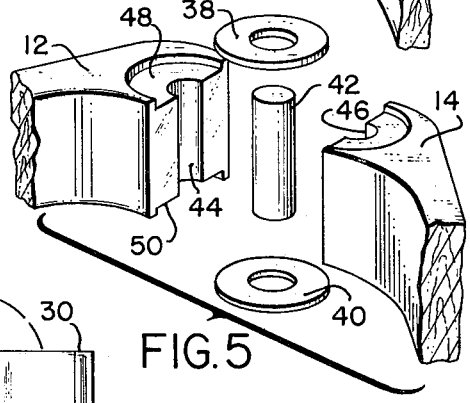
FIG. 5 is an exploded view of the hinged portion of the rack of this invention.

Referring now to FIG. 5, there is shown an exploded view of the unique swivel corners, hinges 30 and 32. The lower ends of arms 12 and 14 are shown in juxtaposition and the swivel hinge consists of two washers 38 and 40 and a dowel pin 42. These dowel pin hinges can be made by drilling through a solid piece of wood at the corner of the triangle, then counter-boring and spot-facing the drilled hole to a depth thickness of the washer on both sides. The corners are then cut precisely in half leaving a half cavity on each part 44 and 46. The two washers 38 and 40 are then fastened to one arm for instance 12, in the counter-sunk spaces 48 and 50. The dowel 42 is then inserted through the washers 38 and 40 and the arm 14 fastened permanently to the dowel 42 completing the hinge.

Figure 6:
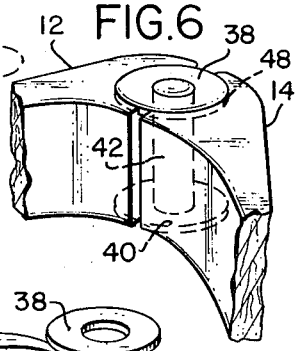
FIG. 6 is a perspective view of the hinged portion of the rack.

Referring to FIG. 6, there is shown arms 12 and 14 and the dowel pin hinge in a closed and fastened position in which washers 38 and 40 are fixed into the counter-sunk holes 48 and 50 and the dowel pin 42 has been inserted in the washers 38 and 40 and fastened to arm 14. The hinge is now in a closed position.

Figure 7:
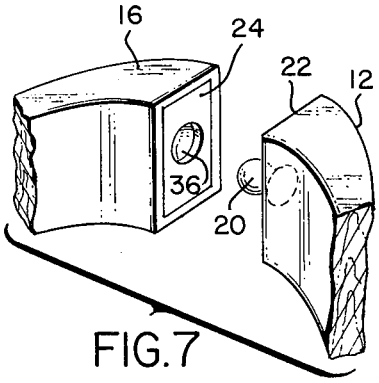
FIG. 7 is a perspective view of the ball and socket joint of the rack.

Referring now to FIG. 7, there is shown a ball and socket or snap button joint at the top of rack 10. At the top portion 22 of arm 12 there is a ball 20 fixedly attached to the face 22 of arm 12. In the face 24 of arm 16 is a socket 36 drilled so that the ball 20 has a very slightly larger outside diameter than the inside diameter of the socket 36 drilled so that the ball 20 has a very slightly larger outside diameter than the inside diameter of the socket 36 so that when they are forced together they have a snap action fit.

The rack of the present invention can be made of any convenient materials such as wood or plastic or even a metal although wood or plastic is preferred due to their reasonable cost. The ball 20 of the ball joint, as well as the dowel 42 and washers 38 and 40 can similarily be made of wood or plastic or metal.

In operation, the pool ball rack 10 of the present invention operates extremely effectively to quickly rack the balls, that is put them all in the rack, force the final fifteenth ball into position popping open the ball joint 20 out of the socket 36 and by quickly rotating in opposite direction handles 26 and 28 the player may simply slide the rack away from balls 18 so that the balls are not touched in any manner when the rack is removed.

Figure 8:
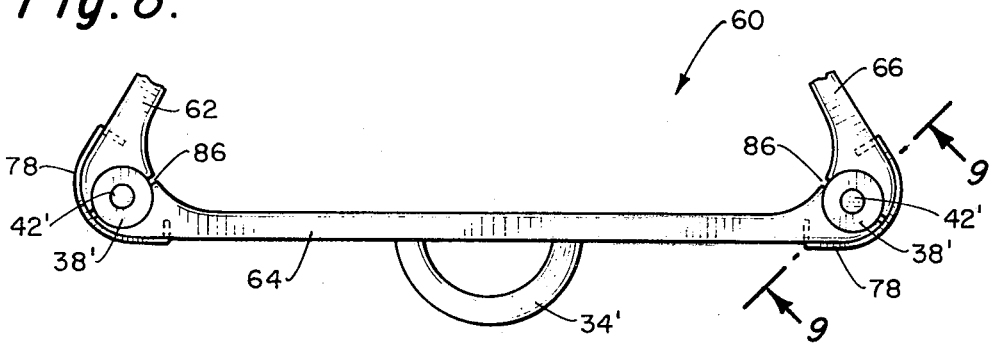
FIG. 8 is a partial plan view of a second embodiment of rack of this invention.
Figure 9:
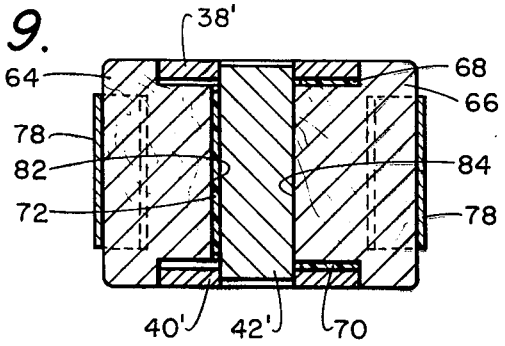
FIG. 9 is a cross-sectional view taken along 9—9 of FIG. 8.
Figure 10:
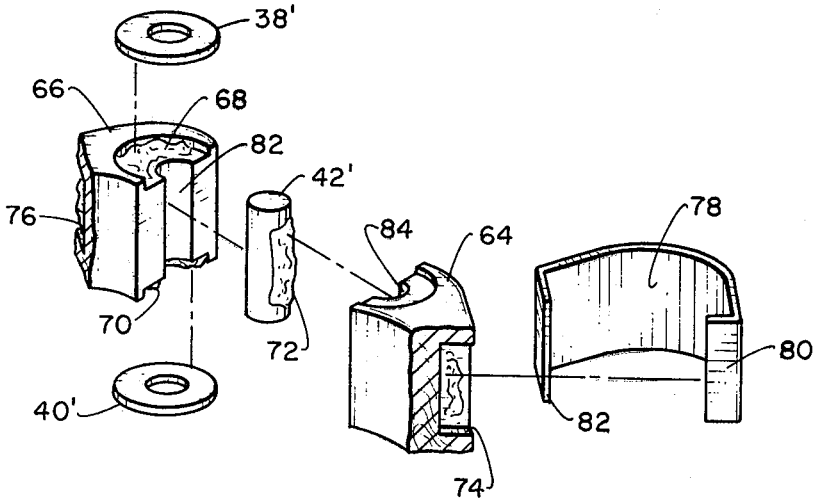
FIG. 10 is an exploded isometric view of the type of hinge joint employed within the modified form of rack of FIGS. 8 and 9.

Referring particularly to FIGS. 8 to 10 of the drawings, there is shown a modified form 60 of rack of this invention. The rack 60 is basically constructed and employed in the same way as rack 10 with the improvements being directed to the hinge joint between the arms. The rack 60 is formed of a first arm 62, a second arm 64 and a third arm 66. It is to be understood that arms 62 and 66 will be interlocked together when the rack is in the non-use position by use of a similar ball 20 and socket 36 as is shown in FIG. 3 of the drawings. Attached to the second arm 64 is also a handle 34' which functions in the same manner as previously described handle 34.

Each hinge joint connection which is used to interconnect arms 62 and 64 and arms 64 and 66 is identical in construction and is basically similar to the previously described hinge joint connection with like numerals being employed to refer to like parts. Arm 66 includes an elongated hemispherical shaped recess 82. Arm 64 includes an elongated substantially hemispherical shaped recess 84. When the arms 64 and 66 are located adjacent one another, the ends of the recesses 82 and 84 communicate with an idented disc shaped recess as was previously described as particularly shown in FIG. 5. Within the elongated recesses is to be located a dowel pin 42'. Adhesive or glue is to be attached to the side of the dowel pin 72 and fixedly secured within the recess 84. The pin 42' is adapted to extend through upper and lower washers 38' and 40' with the washers 38' and 40' being attached by glue 68 and 70 respectively to within the respective disc shaped recesses. Once the glue is dried, the net result is that a certain amount of pivoting action is permitted about the dowel 42' permitting movement of arm 66 with respect to arm 64. The same holds true for arms 62 and 64. It is to be noted that with the dowel 42' in position there is a slight gap 86 between the arms. It is the gap 86 that permits the pivoting movement of the arms and the sidewalls of the gap 86 function as a stop to limit the amount of pivoting movement.

A leaf spring 78 is adapted to be placed around each hinge joint of each pair of arms. The leaf spring 78 is to include inwardly extending ends 80 and 82. End 82 is to be secured within an appropriate groove formed in arm 86 with end 80 being secured within an appropriate groove formed within arm 64. A similar type of leaf spring 78 is positioned about the hinge joint interconnecting arms 62 and 64.

The function of the spring 78 exerts a continuous bias tending to move the arms 62 and 66 inwardly to the closed position. This facilitates the correct positioning of the balls into the triangular shaped shown in FIG. 2 of the drawings.

What is claimed:

1. A billiard ball rack comprising:

a first elongated arm, a second elongated arm, and a third elongated arm interconnected together by connection means to form a triangle shape, said connection means comprises first means hingedly connecting together said first arm and said second arm and said second means hingedly connecting together said second arm to said third arm, said first means is similar in construction to said second means, said first means includes a first groove formed within said first arm and a second groove formed within said second arm, a dowel pin secured to said first groove and located there within, a first washer secured to said second arm adjacent one end of said second groove, a second washer secured to said second arm adjacent the other end of said second groove, said dowel pin to extend through said first and second members and be pivotable in respect thereto, with said dowel pin extending through said washers said dowel pin is positioned within said second groove and the ends of said first arm and said second arm are spaced from each other forming a gap, whereby, said first arm is pivotable in respect to said second arm due to the pivoting motion between said dowel pin and said washers and the width of said gap determines the amount of pivoting movement with the greater the width the greater the amount of pivoting.

2. The rack as defined in claim 1 including:

a biasing means located between said first arm and said second arm and said second arm and said third arm, said biasing means functions to exert a continuous bias tending to locate said rack in the closed position.

3. The rack as defined in claim 2 wherein:

said biasing means comprises a pair of separate spring members with a single said spring member located about each said hinge connection.

* * * * *